United States Patent [19]

Cook

[11] 4,365,576

[45] Dec. 28, 1982

[54] OFFSHORE SUBMARINE STORAGE FACILITY FOR HIGHLY CHILLED LIQUIFIED GASES

[75] Inventor: Sidney F. Cook, Corvallis, Oreg.

[73] Assignee: Cook, Stolowitz and Frame, Visalia, Calif.

[21] Appl. No.: 170,800

[22] Filed: Jul. 21, 1980

[51] Int. Cl.[3] ..... B63B 35/44; E02B 17/00; F17C 1/12

[52] U.S. Cl. ..... 114/265; 62/45; 114/257; 220/8; 405/200; 405/205; 405/210

[58] Field of Search ..... 405/210, 196, 200, 205; 220/8, 85 A, 85 B; 285/3, 18, 302; 114/256, 257, 265, 264; 62/45

[56] References Cited

U.S. PATENT DOCUMENTS

| | | | |
|---|---|---|---|
| 2,280,728 | 4/1942 | Streib | 285/302 X |
| 2,947,437 | 8/1960 | Greer | 405/210X |
| 3,265,408 | 8/1966 | Dickie | 285/18 X |
| 3,643,447 | 2/1972 | Pogonowski | 405/210 |
| 3,675,431 | 7/1972 | Jackson | 405/210 |
| 3,727,418 | 4/1973 | Glazier | 405/210 |
| 3,828,565 | 8/1974 | McCabe | 405/210 |
| 3,837,310 | 9/1974 | Toyama | 405/210 |
| 4,232,983 | 11/1980 | Cook et al. | 405/210 |

*Primary Examiner*—Sherman D. Basinger
*Attorney, Agent, or Firm*—David B. Harrison

[57] ABSTRACT

Improvements in an offshore platform and submarine storage facility for highly chilled liquified gas, such as liquified natural gas, are disclosed. The improved facility includes an elongated, vertically oriented submerged anchoring frame to which one or more insulated storage tanks are moveably mounted so they can be positioned at a selected depth in the water. The double piston tank is constructed with improved seals to transfer ambient water pressure of the selected depth to the cryogenic liquified gas without intermixture. This transferred pressure at the depth selected aids in maintaining the liquified state of the stored liquified gas. Structural improvements to the tank facilitating ballasting, locking the double piston cylinders together and further facilitating surface access to the tank for inspection, repairs and removal, and structural improvements to the platform are disclosed.

15 Claims, 27 Drawing Figures

OFFSHORE SUBMARINE STORAGE FACILITY FOR HIGHLY CHILLED LIQUIFIED GASES

BACKGROUND OF THE INVENTION

The present invention relates to improvements in storage facilities for highly chilled liquified gases. More particularly, the present invention relates to improvements in offshore terminal and submarine storage facilities for liquified energy gases, including liquified natural gas (LNG).

It has been long known to liquify gases, including natural gas, by chilling to reduce volume and thereby facilitate transportation and storage. A significant drawback stemming from the liquification and concomitant concentration of high energy gases is the vastly increased threat to safety and potential for devastation.

A liquid natural gas disaster occurred in the Cleveland, Ohio vicinity in 1944 in which hundreds of people were killed and injured. This disaster effectively terminated the use of liquified natural gas in the United States for the next twenty years.

One the other hand, liquid petroleum gases (LPG) such as propane and butane, have been in widespread uses in both rural and industrial energy applications throughtout the United States for many years. Manmade, synthetic gases are also known and used for energy and other useful purposes.

As local natural gas supplies dwindle, transported and stored liquid energy gases will become an increasingly significant source of energy throughout the world dispite the known hazards. These gases are of three basic types: natural (LNG), petroleum (LPG), and synthetic (LSG) including artificially produced domestic energy gases (i.e., methane and ethane) and industrial energy gases (i.e., acetylene and propylene). These liquified gases are expected to provide a primary source of heat producing energy for the near range future, certainly during the interim until other energy sources such as solar, geothermal and fusion are made practical and economical. Also, of the remaining, readily available energy sources (i.e., coal, oil, gasoline, uranium and gas), only the liquified energy gases burn cleanly, which renders them attractive energy source alternatives to crude oil and coal, as society becomes increasingly concerned with the prevention of air pollution.

Natural gas is a mixture of hydrocarbons, typically 65 to 99 percent methane, with smaller amounts of ethane, propane and butane. When natural gas is chilled to below minus 263 degrees Fahrenheit, it becomes an odorless, colorless liquid having a volume which is less than one six hundredth (1/600) of its volume at ambient atmospheric surface temperature and pressure. When LNG is warmed above its −263 F. boiling point, it boils (i.e., regassifies) and expands to its over six hundred times greater original volume. Thus, it will be appreciated that a 150,000 cubic meter LNG tanker ship is capable of carrying the equivalent of 3.2 billion cubic feet of natural gas.

Of the known liquid energy gases, liquid natural gas is the most difficult to handle because it is so intensely cold. Comlex handling, shipping and storage apparatus and procedures are required to prevent unwanted thermal rise in the LNG with resultant regassification. Storage vessels, whether part of LNG tanker ships or landbased, are closely analogous to giant thermos bottles with outer walls, inner walls and effective types and amounts of insulation in between.

LNG storage tanks in the United States have heretofor been built mostly above the ground with some frozen pit facilities properly characterized as mostly above the ground. Most such tanks have been enclosed by surrounding earthen dikes. Such dikes were sized and emplaced to enclose an area and volume at least as great as the storage capacity of the largest tank within the diked area. Besides the known potential hazards of explosion and inferno created by massive rupture of such tanks, a small rupture, as by a saboteur's bullet or projectile in the upper part of the sidewall could result in a stream of LNG shooting beyond the dike, thereby rendering it useless to contain the hazard of a spill and creating the consequent likelihood of explosion and fiery inferno.

Surprisingly, until recently little attention has been focused upon the ocean and its vastness as a potentially safer environment for storage facilities for liquified energy gases, including LNG. A partially submerged offshore storage tank for liquified energy gases was disclosed in the Jackson U.S. Pat. No. 3,675,431 issued July 11, 1972. That patent described an insulated tank which was prefabricated, floated to a suitable offshore site and then sunk until its submerged base rested on the floor of the sea. An upper above-the-water domed metal cylinder extended from a concrete base. Insulation lined the interior of the tank. A thin and flexible membrane inside the insulation provided the required liquid tight interior lining of the tank. The insulation lining the submerged portion of the tank was said to be thinned, so that a layer of ice formed around the outside of the concrete base when the tank was filled with liquified gas. In accordance with the invention claimed in the patent, the ice layer supposedly acted as an outer seal for the submerged concrete.

Another prior art LNG storage facility concept was disclosed in the Glazier U.S. Pat. No. 3,727,418, issued Apr. 17, 1973. The Glazier patent described having an insulated interior membrane. A balancing fluid, said to be isopentane (2-methyl butane) transferred hydrostatic pressure from surrounding ambient water to the LNG contents.

A still different approach was described in the offshore LEG storae facility disclosed in the McCabe U.S. Pat. No. 3,828,565, issued Aug. 13, 1974. Therein, an insulated buoyant tank moved telescopically up and down in a larger receiver tank containing seawater, oil or other liquid in accordance with the quantity of LEG at atmospheric pressure stored therein from time to time.

Yet another underwater storage apparatus was disclosed in the Toyama U.S. Pat. No. 3,837,310 issued Sept. 24, 1974. Therein, a torus shaped buoyancy control tank surrounded a larger spherical submerged offshore oil tank. The slight positive buoyancy was equalized over the range of oil storage capacity by the introduction or removal of water ballast from the buoyancy control tank. The Toyama facility was tethered to a base at the seabed by a plurality of cables.

Subterranean storage vessels for LNG have been used in Japan with some claimed advantages over surface, landbased storage facilities. Nevertheless, the hazards presented by such facilities, particularly from earthquake damage, remain unabated. Also inspecting and maintaining such facilities was extremely difficult and hazardous.

Another prior proposal for offshore underwater storage of crude petroleum product was described in the Pogonowski U.S. Pat. No. 3,643,447, issued Feb. 22, 1972. Therein, a frame anchored to the sea floor supported an expansible, bladder-like tank held to the frame at a predetermined depth below the surface. Crude petroleum from an undersea well was piped into the tank continuously and caused it to expand. A delivery conduit from the tank extended to the surface and delivered the crude into tanks of an awaiting barge or ship. Latent hydrostatic lifting pressure developed by sea pressure against the flexible tank was used to force the crude out of the bladder-like tank, through the conduit, and into the awaiting tanker without pumping being required. While the Pogonowski contrivance might have been feasible for storage of liquid crude at ambient sea temperatures, the use of ambient water pressure to maintain the liquid state of the liquified gas, or the use of depth in the water to dissipate small leaks from the facility without the danger of fire or explosion.

The primary direction in which offshore LNG storage has moved in the past two years has been embodied by floating moored terminals. These floating terminals offer some advantages over land based storage, i.e., isolation from population centers and minimization of contact with real property and fixed structures, minimization of effect from earthquake hazards, removal of the need to dredge in order for tankers to approach the facilities, and need for large tracts of land to be used as buffer zones. Two primary designs exist: A semisubmersible floating tank structure moored near or under a floating liquefaction plant embodied by the design set forth by a European consortium led by Linde AG of West Germany. The second design, proposed by Imodco-General Dynamics, embodies a flat bottomed, square-ended barge moored by a single point mooring system (SPM). While both of these designs overcome many of the problems inherent to land based storage as mentioned above, they still have many disadvantages. They are subject to buffeting by severe sea conditions, which results in slosh and, subsequently, in a tendency for a portion of the liquified gas to flash to a gaseons phase from internal (intermolecular) friction. They are susceptible to collision and damage from surface vessels. They are susceptible to aerial and surface assult. They are susceptible to fire and explosion due to storage in or near an atmospheric storage medium which supports combustion, and, while the facility is removed from population centers and large tracts of real property and fixed structures, the facility itself would be subject to catastrophic loss. This would surely result in the loss of the facility operations crew, the loss of a costly facility, interruption in the storage/liquefaction network, and possibly the loss of a very costly LNG transport vessel.

A radically different and vastly improved offshore storage system is disclosed in my co-pending patent application with Mark Stolowitz, co-inventor, Ser. No. 967,472, filed Dec. 7, 1978, entitled Offshore Submarine Storage Facility for Highly Chilled Liquified Gases, now U.S. Pat. No. 4,232,983. Therein, an offshore tanker terminal and submarine storage facility for chilled liquified gases included an elongated vertical frame work anchored to the sea floor. A variably ballasted insulated storage vessel formed of two slidably meshing pistons chambers with herispherical ends, moved up and down in the framework, like an elevator, so that external ambient seawater pressure available at a depth selected for the desired pressure was applied to the liquified contents of the vessel to inhibit regassification.

Since making this original invention, I have invented certain improvements which are disclosed hereinafter which render the original invention even more useful, practical and feasible for widespread adoption and use for offshore storage and handling of liquified energy gases.

SUMMARY OF THE INVENTION

A general object of the present invention is to provide improvements in a submarine sea-pressure-transfer vessel storage facility for highly chilled liquified energy gases.

Another object of the present invention is to provide a submarine storage facility facilitating surface level inspection maintenance and replacement of one or more sea-pressure-transfer submarine storage vessels.

A further object of the present invention is to provide improvements in seals at the sea pressure transfer interface of the double piston-chamber submarine storage vessels.

Yet another object of the present invention is to provide an improved buoyant submarine storage surface facility tethered by cables to the seabed, in which the double piston storage vessels are retained in the facility by the cables.

A still further object of the present invention is to provide an improved variable ballasting configuration for the double piston-cylinder submarine storage vessels.

One further object of the present invention is to provide improvements in safety mechanisms of the double piston submarine storage vessels.

The present invention provides improvements in an offshore submarine storage facility in the ocean and the like for handling and storing liquified materials at cryogenic temperatures wherein the facility includes a vertically compressible insulated submarine storage tank positionable at various selected depths in the water, for storing the liquified material and for transferring external ambient water pressure available at a selected depth to the liquified material to aid in manufacturing its liquid state without intermixing seawater.

One improvement includes a buoyant platform at the surface, with a plurality of tensioned cables tethering the platform to a base, with the cables serving as guides for the tank or tanks.

Another improvement includes a single platform for a plurality of tanks, wherein the platform includes a central opening and mechanism for receiving and lifting a tank out of the water for inspection and maintenance.

Another improvement includes a release mechanism for releasing the tank from its frame so that it may be towed away for repair or replacement.

Another improvement includes a more effective seal mechanism at the double piston-cylinder interface of the tank; in one form of the invention a rotatable torus shaped "doughnut" seal rotates within a circumferential trough as the tank parts slide relative to one another.

Another improvement includes a series of opposed segmented inward and outward flunges at the extremity of the tank members which prevent tank separation when the members are indexed in a locking position yet which enables the members to separate when the members are rotatably indexed about the vertical axis to an open position.

Another improvement provides a more effective ballasting system within the tank to assure full depth control over the tank for all ambient operating conditions.

Another improvement provides a disconnect mechanism to facilitate coupling and decoupling the umbilical from the platform to the tank.

Another improvement provides a telescoping material conduit within the tank which tracks the expansion and contraction of the tank as the upper and lower members thereof move relatively to each other.

These and other objects, advantages and features of the present invention will be apparent from a consideration of the following detailed description of preferred embodiments, presented in conjunction with the accompanying drawing.

BRIEF DESCRIPTION OF THE DRAWINGS

In the Drawings:

FIG. 2 is a view in perspective of a segment of one of the double walls of the tank depicted in FIG. 10, showing some of the seals depicted in FIG. 19.

DETAILED DESCRIPTION OF A PREFERRED EMBODIMENT

The following description incorporates by reference some of the description set forth in the Cook and Stolowitz U.S. Pat. No. 4,232,983, supra. Common elements between the storage facility of that patent and this preferred embodiment of the present invention bear like reference numbers.

Figure 1:
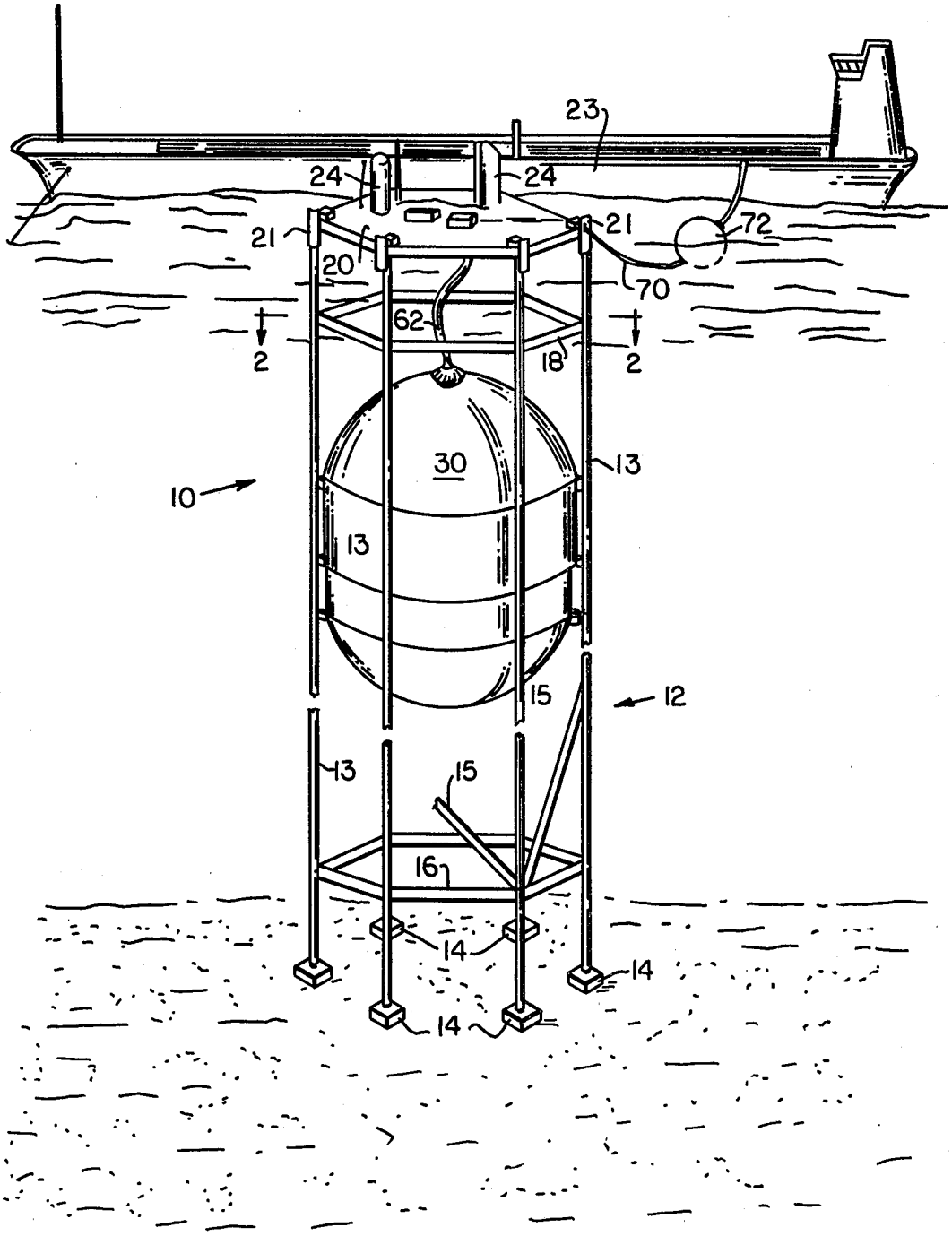
FIG. 1 is a somewhat diagrammatic view in perspective of an offshore submarine storage facility for highly chilled liquified gases which incorporates the principles of the present invention, the facility being broken in height in order to conserve space.

A liquid energy gas terminal and submarine storage facility 10 including improvements in accordance with the principles of the present invention is shown diagrammatically in its intended offshore environment in FIG. 1. While the facility 10 is shown and discussed as constructed in the ocean, it may be used to advantage in any body of water providing there is a sufficient depth available. A large facility, such as the facility 10, works best when the available depth of the body of water is a least 400 feet below mean surface level.

The facility 10 includes framework 12 having six vertical legs 13 which are arranged generally to define a hexagon in a horizontal section. The selection of a hexagonal geometry for the framework 12 provides adequate structural support for the facility 10 while minimizing loading resulting from tidal and other currents in the ocean environment. The framework 12 is secured to reinforced concrete pilings 14 which are driven into the floor of the sea. Lower horizontal bracing 16 and upper horizontal bracing 18 connect the vertical members 13 of the framework 12 to provide structural integrity to the facility 10. In practice, triangular members 15, shown broken away in FIG. 1 so as not to obsure the principles of the invention, are also included in accordance with standard structural design practices to interconnect the vertical members 13 of the framework 12 and assure integrity to the framework 12.

A surface level generally hexagonal platform 20 is supported at the upper end of the framework 12. The platform 20 is located just above the surface of the sea and supports the operating controls of the facility 10. The platform 20 may provide a dock 21 for mooring carriers, and may include floating buoy transfer equipment 70,72 for removing liquid energy gas from a large draft carrier 23 which may be moored by an anchor line adjacent to, but not touching the platform 20. The platform 20 also supports reliquefaction equipment 24, living quarters for operating and maintenance crews and a heliport for air transportation to and from the facility 10.

A two part double piston tank assembly 30 is positioned within the framework 12 via rollers 32. The tank assembly 30 is sized and constructed to slide vertically within the framework 12, and is moved up and down to different depths in the water by regulation of its relative buoyancy.

Figure 10:
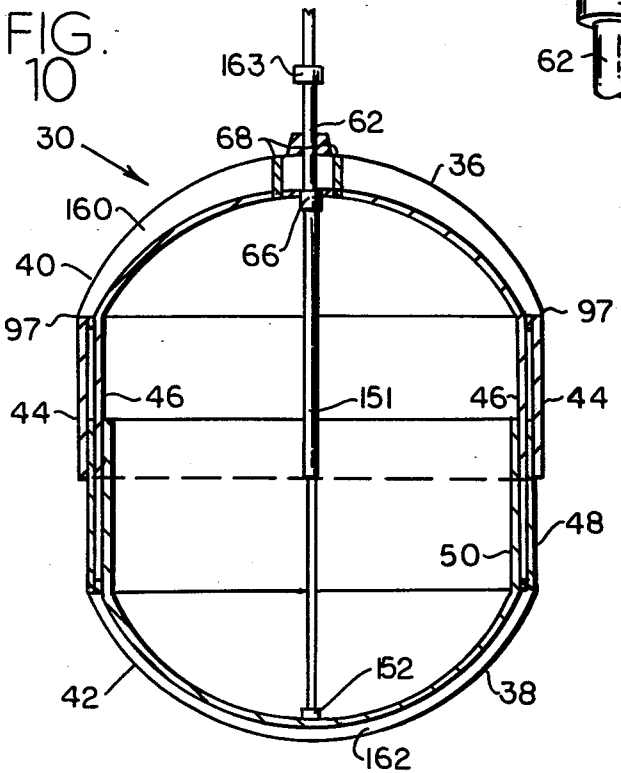
FIG. 10 is an enlarged view in side elevation and vertical section of the submarine storage tank depicted in FIG. 1.

Referring briefly to FIG. 10 for an overview, a reinforced insulated implosion dome 40 forms the top of the upper section 36 and a complementary reinforced insulated implosion dome 42 forms the bottom of the lower section 38. Cylindrical double-double walls 44 and 46 of the upper section 36 interleave with complementary cylindrical double-double walls 48 and 50 of the lower section 38 to provide the piston against piston telescoping double-double wall construction of the tank assembly 30. Each wall of the walls 44, 46, 48, and 50 is a sandwich construction. Thin outside metal plates 52 and 53 are secured to a rugged but largely open internal frame 54. Insulating material 56, preferably perlite or equivalent, fills the spaces and interstices between the exterior plates 52. The members of the internal frame 54 are of very low heat conductivity material to minimize heat transfer through the walls, 44, 46, 48 and 50 while providing structural integrity thereto.

The tank assembly 30 is usually operated at a depth below the thermocline and effective photic zone. In addition, the outside of the tank is provided with a marine growth retardant coating, such as marine antifouling polymers. By these precautions, marine organism attachment of the tank, which would otherwise interfere with the compression/expansion movements of the complementary sections 36 and 38 is for practical purposes eliminated.

Figure 2:
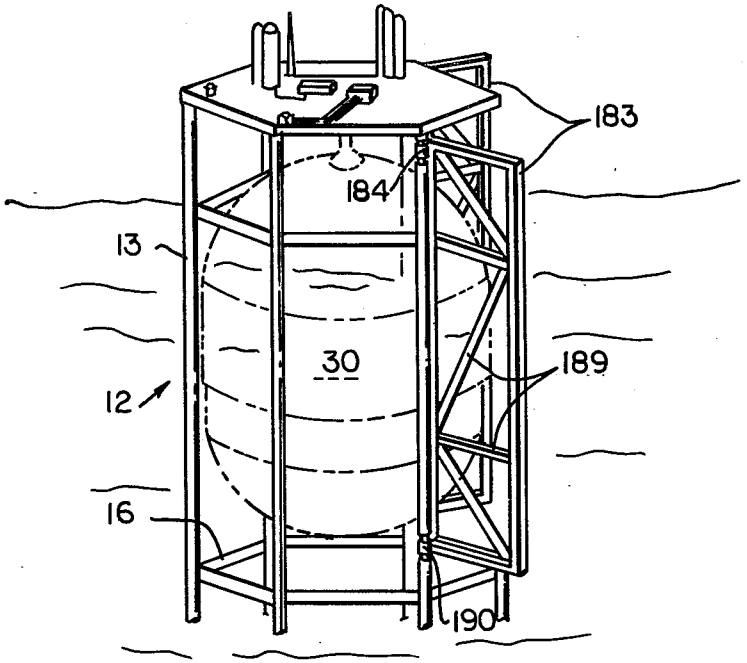
FIG. 2 is a diagrammatic view of the surface portion of another storage facility facilitating installation and removal of the submaarine storage tank shown in FIG. 1.

Referring now to FIG. 2, in order to facilitate installation and removal of a tank assembly 30, for inspection, maintenance or replacement, from the framework 12 at surface level, a moveable gate subassembly 183 is provided as a part of the frame 12. The gate 183 is formed of two open rectangular doors forming, in closed position, one of the vertical support legs 13. The gates extend into the water to a depth sufficient to enable a tank 30 floating with approximately 10% of its vertical height above water level to be moved through the opening in the support frame when the gate 183 is open.

An upper hinge 184 and a lower hinge 190 are provided for each door. Each hinge is preferably formed as a journal around an adjacent support leg 13, so that each door opens radially from the leg to which it is rotatably mounted.

As with other portions of the framework 12, each door is preferably strengthened by cross members 189 which provide structural integrity.

Each door may be lowered by a motor (not shown) in the platform at the upper journal 184. Alternatively, the doors may be opened by winches, or by a tug boat which would be utilized to tow the tank to an inspection or repair facility once it has been removed from the frame 12.

As offshore gas fields are developd in deeper and deeper waters, a need has arisen for platform systems which do not depend upon rigid vertical supporting frames anchored to the seabed, such as the framework 12, depicted in FIGS. 1 and 2. Consequently, in FIG. 3, I have adapted from known offshore platform technology a floating surface platform 195 tethered to the seabed which includes the generally hexagonal deck 20. The deck 20 is supported above the ocean surface by six hollow, variably ballastable vertical support legs 196 which are submerged by flooding to a desired depth, so that the deck 20 is stabilized just above the water surface. Lower horizontal hollow frame members 197 provide additional ballasting capability and are integrally connected to and form a part of the vertical hollow legs 196.

Stationing cables 198 connect to the lower point of each hollow leg 146 and are secured to an anchoring platform 200. The anchoring platform 200 is a weighted structure of concrete or other suitably heavy materials resting upon and anchored to the seabed in conventional fashion. The stationing cables 198, which are arranged in a generally hexagonal plan pattern serve as guide wires for the tank assembly 30. Ball bearing lined sleeves 201 extend from the tank 30 and slidably engage the guide cables 198. Each sleeve 201 is preferably of hinged configuration along a vertical axis, so that when the sleeve is opened, the tank 30 may be separated from a cable 198 or from the frame 12 to facilitate installation, inspection, repair and/or replacement of the tank 30, cable 198, or sleeve bearings. In use, the sleeve 201 would be securely fastened, as by bolts, in its closed configuration.

A series of spheres formed of synthetic resin polymers, such as Teflon made by DuPont, is arranged circumferentially within each sleeve 201, so that the sleeve slides easily up and down on its particular cable 198.

The floating surface platform may be configured to include a gate system 183 similar to the system described above in connection with FIG. 2. A pair of support cables 199 extend from the platform 200 to the lower outside ends of the doors of the gates, and are located on opposite sides of each stationing cable 198 for the purpose of providing additional back up for main cables.

In the process of installing or removing the tank 30, it may be preferred, because of ocean currents or other environmental conditions to detach all sleeves except the two on one of the cables 198 located adjacent the gate 183. In this manner the tank may be rotated about the single attachment cable 198 while the gate 183 is opened so that it may pass out of the gate 183 and then be connected to a tugboat and later detached from the last cable, so that the possibility of the tank becoming uncontrolled during separation from its frame, and possibly damaging itself or the frame, is minimized.

Referring to FIGS. 7–9 and 26, one preferred embodiment of the sleeves 201 is depicted. Therein, the sleeve 201 includes a series of ball bearings 204 which are rotatably seated in a housing 205 and held in place by bearing retaining plates 206 secured to the housing 205 by bolts 207. A vertical hinge 208 enables the housing 205 to be opened, and a locking bolt 211 holds the housing 205 in its closed, operating portion around a cable 198. The housing 205 is rigidly joined to a slide support arm 209 which extends from the tank 30. Additional triangler bracing 210, at the junction of the housing 205 and arm 209 provides reinforcement.

Figure 3:
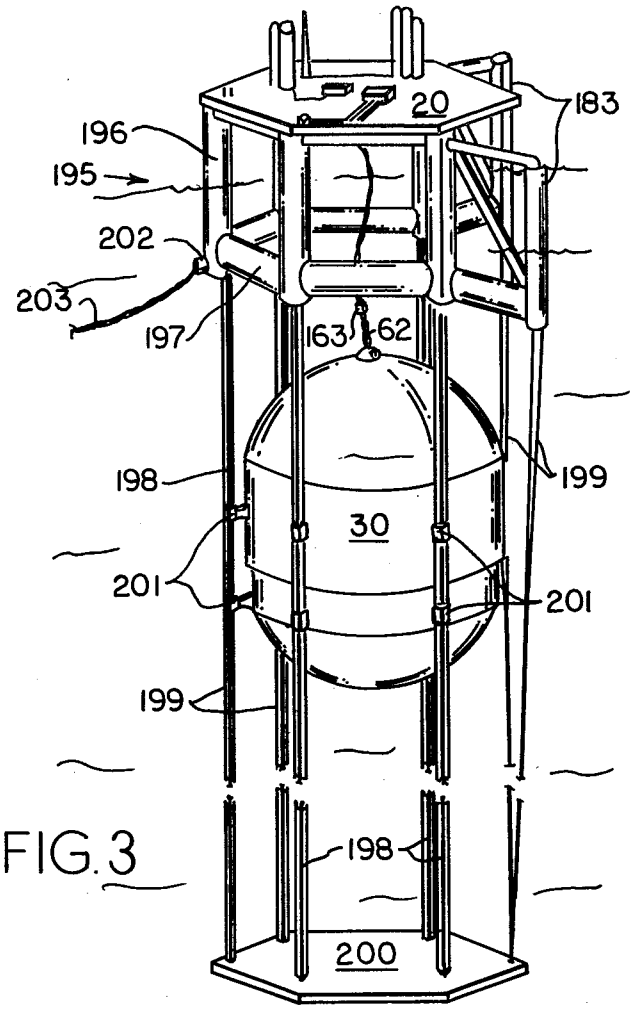
FIG. 3 is a diagrammatic view in perspective of another offshore submarine storage facility having a buoyant surface platform held in place by tensioned submarine cables anchored to the seabed on which the tank moves up and down; this facility is also broken in height, and it incorporates the present invention.

The tank 30, shown in FIG. 3, is provided with a material handling umbilical cable 62 extending to the platform. A safety disconnect coupling 163, described later herein, is provided in the umbilical line 62. A subsurface coupling 202, secured to the lower end of one of the hollow legs 196, and a transfer conduit 203 extending from the coupling facilitate the loading and unloading of cryogenic material stored in the facility.

Figure 5:
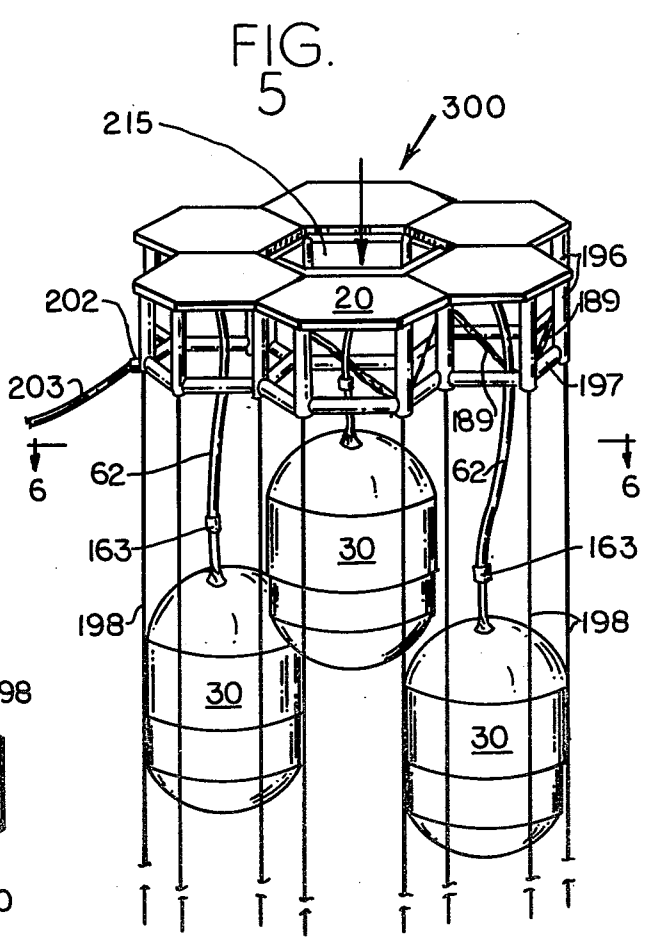
FIG. 5 is a like view as FIG. 4 except the dry dock has been returned to submarine storage service.
Figure 6:
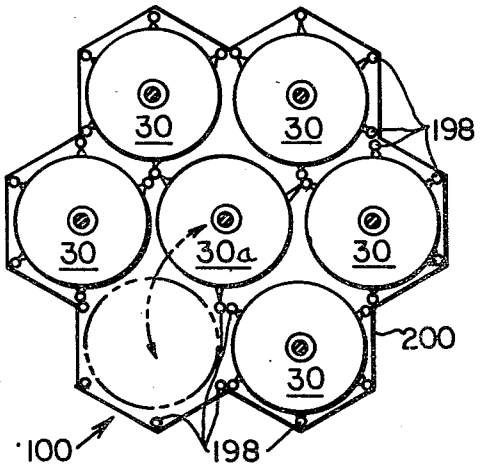
FIG. 6 is a top plan view in section taken along the line 6—6 in FIG. 5.
Figure 4:
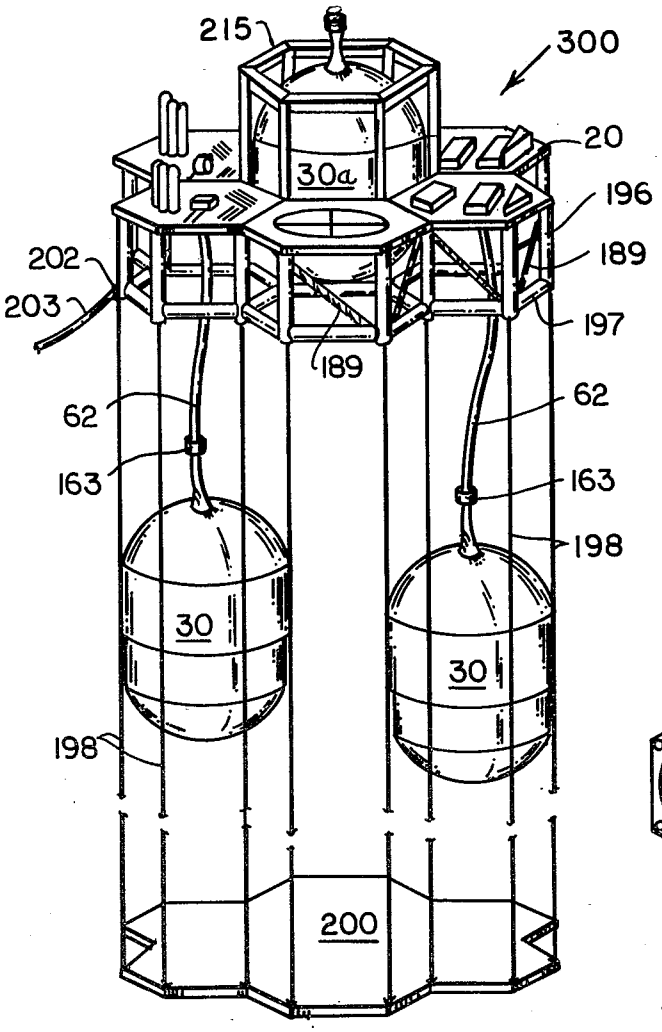
FIG. 4 is a diagramatic view in perspective of a six-cell storage facility in accordance with the present invention having a buoyant surface platform, taut submarine cables and two of the six tanks shown in the water and a third in a central maintenance dry dock; this facility is broken in height, too.

The multiple tank facility 300 depicted in FIGS. 4–6 sets forth another improvement. Therein, the surface platform 20 is formed of six adjacent hexagons, arranged in a circle and the base 200 is of a geometrically similar outside geometry. With the configuration 300, six tanks 30 are provided for. Each tank is guided by five cables 198, as depicted most clearly in FIG. 6. The cables are arranged so that each tank 30 is able to pivot about an inner cable 198 so that it becomes positioned in a central, maintenance and inspection position. A hydraulic carriage 215, shown in extended position in FIG. 4, and in retracted position in FIG. 5 is located in the central opening. The carriage 215 engages a tank 30*a* in the central position and lifts it entirely out of the water, as shown in FIG. 4. This enables the tank 30*a* to be separated, its seals replaced, its interior and exterior cleaned and inspected and the tank 30, then returned to service at the side of the facility. The carriage 215 is shown in its normal retracted position in FIG. 5. The legs 196 and the lower members 197 are provided with sufficient ballast capability to enable the platform to lift one tank 30*a* completely out of the water at a time. The maintenance of one tank 30*a* does not interfere with the storage of cryogenic materials in the five other submerged tanks 30, the drawback of one sixth less storage capability during maintenance being offset by the ability to maintain at the facility 100.

Turning once again to FIG. 10 an improved tank 30 is depicted in vertical section. The tank assembly 30 comprises an upper half 36 and a complementary lower half 38. This tank has a number of improvements over the original tank concept.

Figure 13:
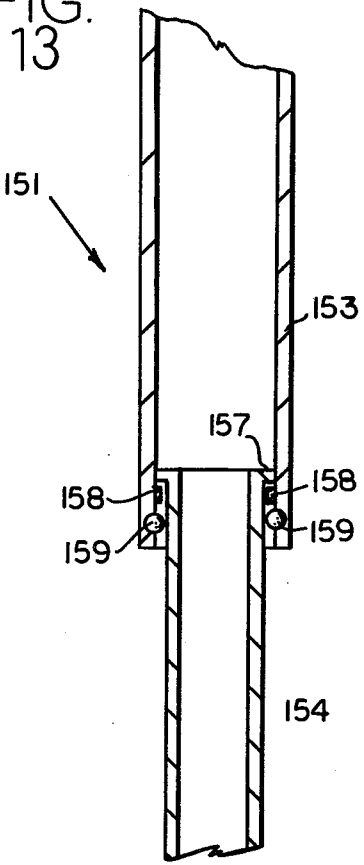
FIG. 13 is an enlarged view in side elevation and vertical section of the telescope joint seal of the materials transfer pipe in the interior of the tank depicted in FIG. 10.
Figure 12:
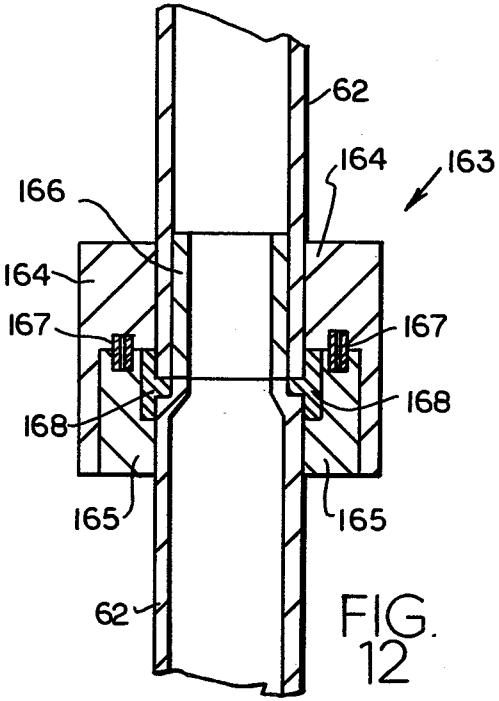
FIG. 12 is an enlarged view in side elevation and vertical section of the coupling depicted in FIG. 11, shown in a connected position.
Figure 11:
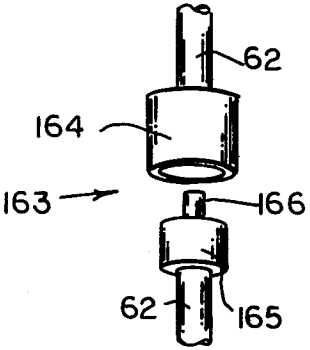
FIG. 11 is an enlarged view in perspective of the emergency umbilical separator coupling depicted in FIG. 10, as shown in a disconnected position.
Figure 15:
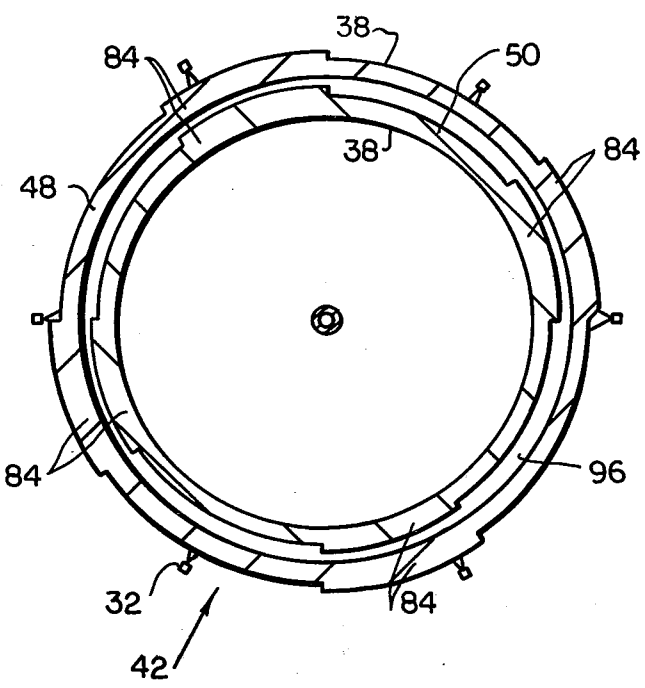
FIG. 15 is a top plan view of the lower half of the double piston tank depicted in FIG. 10 illustrating the radially outward locking dog segments which are aligned vertically with the segments depicted in FIG. 14 when the tank is in its assembled state.
Figure 14:
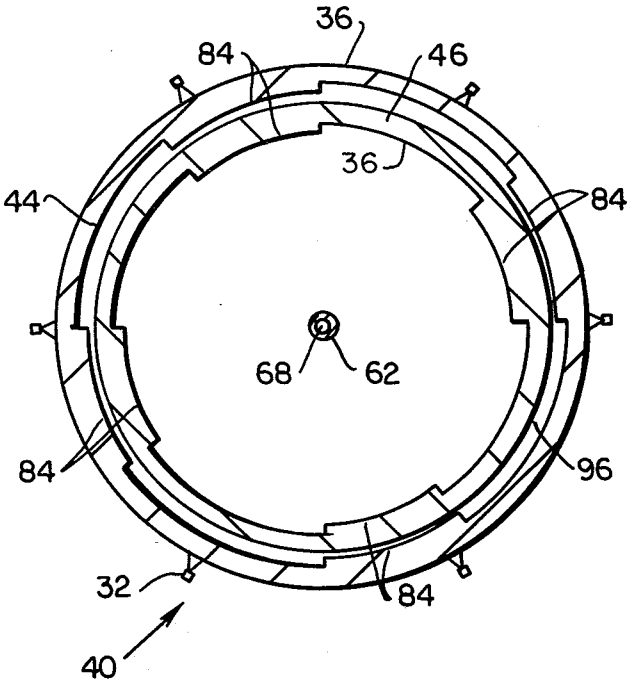
FIG. 14 is a bottom plan view of the upper half of the double piston tank depicted in FIG. 10 illustrating the radially upward locking segments.

The tank 30 includes a substantially larger ballast water tank 160 in the upper half section, 36, which is uninsulated and free to transfer with surrounding ambient water. The emergency umbilical separator coupling 163 is depicted in FIGS. 11 and 12, while an improved internal telescoping transfer pipe 151 is depicted in FIG. 13. An improved locking mechanism for the upper and lower sections 36 and 38 is illustrated in FIGS. 14 and 15. Improved seals are depicted in FIGS. 16–25. Each of these improvements will now be discussed.

To minimize dimensional contraction in the tank structure because of the extreme thermal gradient suitable structural materials must be utilized. With a tank having a 70 foot diameter a diametrical change of only 0.37 inches will be experienced if the tank is constructed of a 36 percent nickel-in-iron alloy (Invar). For other nickel steel alloys a change of 1.44 inches will be realized. For stainless steel the dimensional difference is 2.16 inches, while the figure for a tank of aluminum alloys is 2.88 inches.

In order for the tank assembly 30 to remain controllably submerged at a desired depth, the tank and its contents must be negatively buoyant. As liquid energy gas is less dense than sea water, the greatest ballasting will be required when the tank is storing its maximum safe quantity of LEG material. Variable ballast, such as sea water, is loaded to the ballast tank 160 via vents in the hemispherical upper end 40 of the upper hull section 36. The amount of ballast is a function of the displacement volume and mass of the tank assembly 30 at a given depth. Automatic equipment at the platform adjusts the ballast to move the tank 30 to a depth in the water which will provide sufficient ambient pressure on the tank 30 to maintain and promote the liquid state of the stored LEG contents. Fixed ballast, such as wet sand may be provided in a lower ballast tank 162 in the hemispherical end of the bottom section in such quantity as enables the tank 30 to operate from the surface to the maximum desired depth throughout the range of material storage conditions.

The emergency unbilical separator coupling 163, depicted in FIGS. 11 and 12, provides a mechanism for severing the semi-flexible umbilical 62 extending from the top of the tank 30 to the platform 20 in the event that an emergency situation arises which requires sinking the tank 30 to the maximum available depth. In that event, it is desired to seal the tank from the ambient sea. The coupling 163 includes a receptacle end 164 and a plug end 165. Explosive bolts 167 ordinarily secure the parts of the coupling together. The bolts would be actuated by an emergency control signal sent to close a cutoff valve 66 within the tank 30. A seal 168 at the interface of the coupling provides a barrier against leakage of any liquid or gas passing through the umbilical conduit 62. The coupling would remain serviceable so that connection could be reestablished later to facilitate off loading of LEG in preparation for raising the tank.

Figure 16:
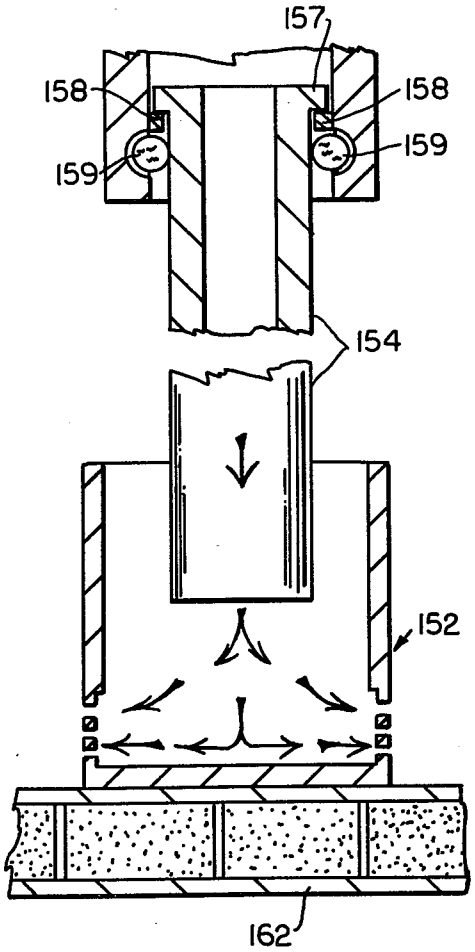
FIG. 16 is an enlarged view in partial section of the telescope joint and lower portion of the materials transfer pipe within the tank depicted in FIG. 10, with other portions broken off to save drawing room.

The telescoping transfer pipe 151, depicted in FIGS. 10, 13 and 16 includes an upper member 153 and a lower member 154. An outward flange 157 is provided at the upper end of the bottom member 154 while a complementary inward flange 158 is provided at the lower end of the upper member 153, just above a rotating o-ring seal 159, of a type to be described hereinafter. The lower member 154 is secured at its lower end to an anti vortex housing 152 which mechanically anchors the transfer pipe 151 while facilitating free flow of stored liquid material to and from the tank 30 at the lowermost point therein.

An improved fixed locking dog configuration for the tank assembly 30 is depicted for each tank section 36 and 38 in FIGS. 14 and 15 respectively. Therein, complementary aligned flange segments 84 extend inwardly on the section 36 and outwardly on the section 38. When the sections are placed together initially, they are aligned so that the segments on the upper section 36 pass between the segments on the lower section 38. Then, one section is rotated relative to the other, so that the inward and outward segments become aligned vertically. At greatest safe extension of the sections 36 and 38, the complementary segments 84 abut each other and prevent the tank 30 from coming apart. A registration maintenance mechanism, such as a vertical slot in one section and a removable key in the other prevents unwanted relative rotation, until maintenance or inspection of the tank 30 is desired.

Figure 17:
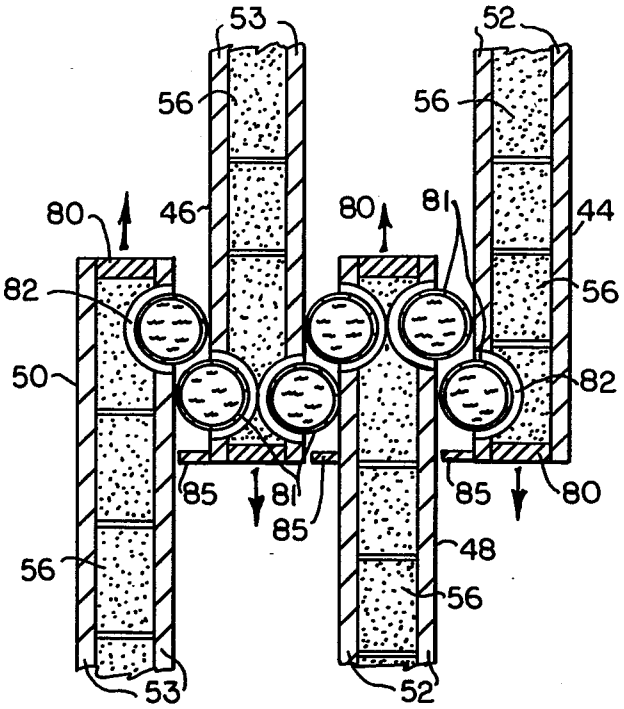
FIG. 17 is an enlarged view in side elevation and vertical section of a double wall segment of the tank depicted in FIG. 10, illustrating one seal arrangement of the present invention.

Referring now to FIG. 17, the preferred mechanism to prevent the intermixture of the contained LEG liquid and the ambient water embodies the use of a seal 81 which is constructed in a manner very similar to semi-flexible LNG transfer hoses now in commercial use, i.e., a tightly interwoven tube of metallic or nonmetallic strands of structural material and insulatory materials. They are flexible when assembled and the flexibility afforded enables the tube to be deformed without plastically deforming the constituent materials comprising the tube, thereby preventing the structural weakening of a solid constituent material that occurs when it is plastically deformed. This tube 81 is formed into a hollow doughnut and sealed at the juncture of the two ends to make it liquid tight at that point. The seal 81 rests in a seal cradle 82 that is a semicircular depression formed in the side of the corresponding hull sidewalls 44, 46, 48, 50. The cradle is itself constructed of a non-metallic, low heat transfer material overcoated with Teflon or a similar material anchored in such a way that the Teflon could expand and contract as thermal conditions dictated, i.e., Teflon would only be anchored to the underlying support material at the center with the rim of the Teflon trough free. The Teflon trough (cradle) 82 may also incorporate a design in which the bottom of the cradle is thicker than the rims to facilitate the movement of the seal 81 in the cradle 82.

The seal 81 is filled with an organic liquid, 83, preferably of low to moderate molecular weight and having the characteristics of being a liquid at both ambient temperatures and at LEG storage temperatures. There are several alkanes which may be use, although this is not meant to be limiting to the alkanes only. The purpose of this fluid 83 is to provide a suitably dense medium in a viscous state which would act to return the seal to a circular cross section after it had been deformed by expansion and contraction of the hull walls and their subsequent movement together or apart. This would keep a consistent contact between the seal, the cradle, and the opposing hull section to ensure adequate sealing. In practice the seal 81 is only filled to 90–95% with liquid, leaving a small bubble of air inside to improve its overall performance. These components 81, 82, 83 work together to provide a seal which is capable of rolling inward or outward without damage, thereby producing a seal which freely rotates in the seal cradle as the walls 44, 46, 48, and 50 slide in and out.

By placing a seal protector 85 below the seals 81 in each hull the amount of particular matter traped in the dead space of the hulls or at the water interface is minimized and thereby prevented from fouling the seals.

Figure 18A:
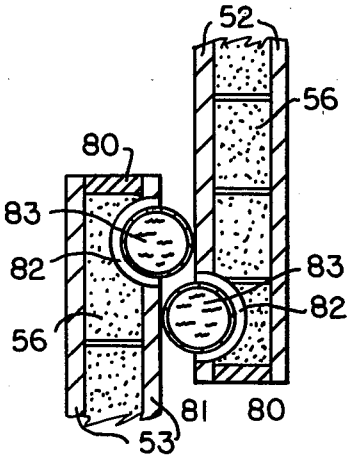
FIGS. 18A and 18B illustrate diagrammatically the operation of the seals depicted in FIG. 17.
Figure 18B:
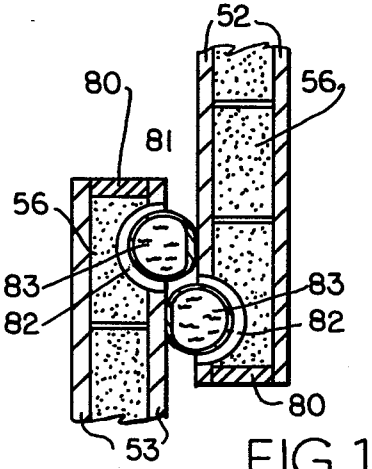

As shown in FIG. 18, by placing seals in such a way that two seals abut each other at the maximum extension of the tank halves a system of preventing the tank halves from separating is provided. In this supplementary application the seals act also as locking dogs over the entire 360 degree perimeter of the tank. Additionally, by placing seals at the LEG-dead space interface, the dead space-dead space interface and the dead space-ambient water interface liquid or gases going either way would have to negotitate six (6) barriers to become intermixed. Anywhere from 6 to 12 seals at least could be reasonably used although only six are shown in the preferred embodiment. Further, by placing seals between each set of hulls, each of the walls can adjust freely to the effects of thermal expansion and contraction independently of one another.

Figure 19:
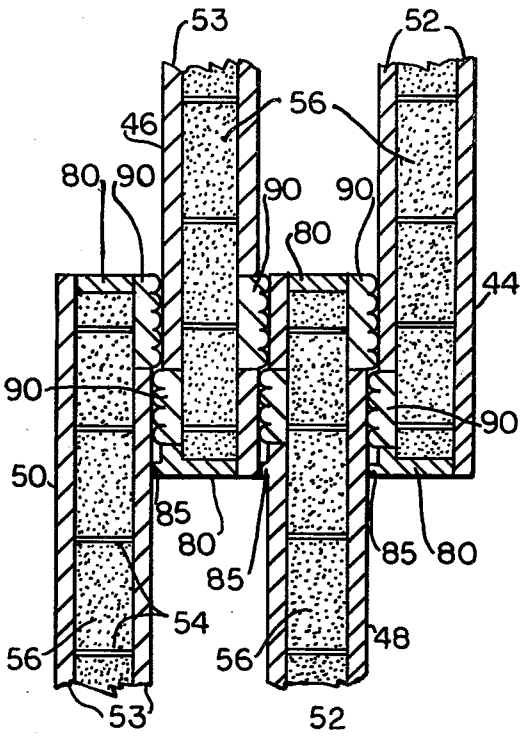
FIG. 19 illustrates an alternate seal configuration to that depicted in FIG. 17.
Figure 21:
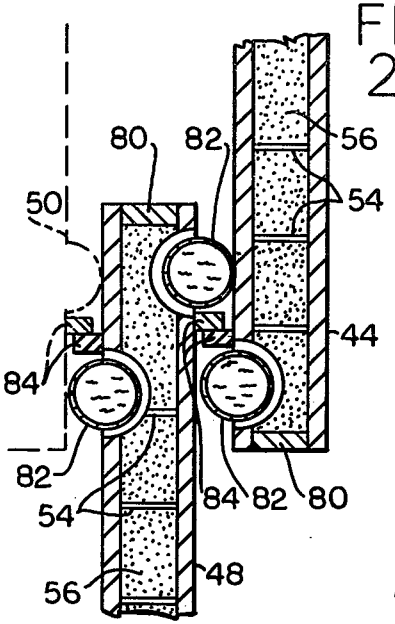
FIG. 21 is a view in vertical section and side elevation of a double wall segment illustrating an alternative seal and locking dog arrangement.
Figure 22:
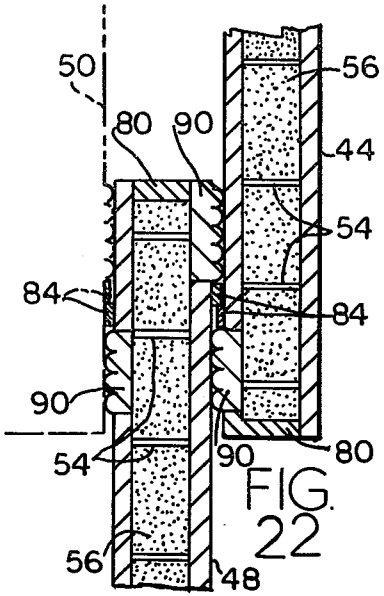
FIG. 22 is yet another alternative seal and locking dog arrangement.
Figure 20:
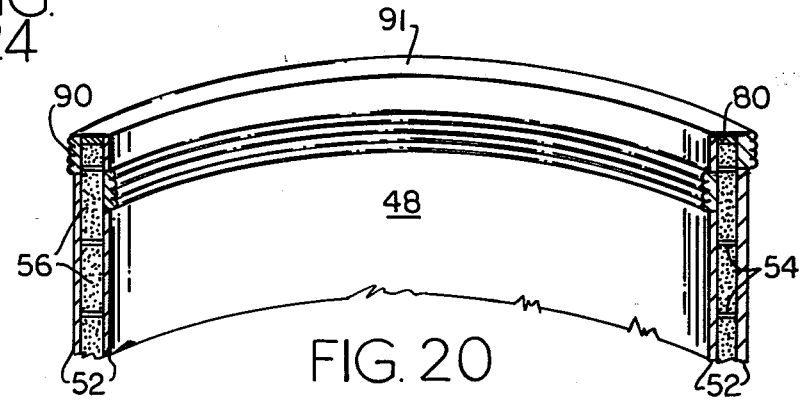
Figure 23:
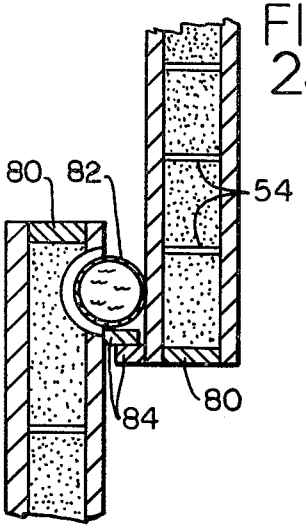
FIG. 23 is an alternative to the seal and locking dog arrangement depicted in FIG. 21.
Figure 24:
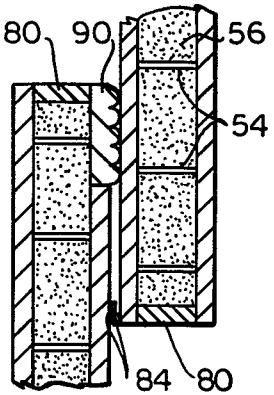
FIG. 24 is an alternative to the seal and locking dog arrangement depicted in FIG. 22.

Referring now to FIGS. 19 and 20, an alternate method of sealing the tank 30 is to provide multiple sets of rings 90 each having a smooth annular seating surface and a scalloped or serrated sealing surface defining a plurality of annular semi-tori. These act in a manner similar to the rings in a car engine piston. The effect of the multiple rings 90 is to restrict flow of a portion of the material coming in contact with them. If enough seals are placed in adjoining positions the result is that no material passes the barrier thus formed.

The seals 90 can be multiplexed as with the seals in FIG. 18 to produce a more effective seal system, while at the same time also serving as locking dogs to keep the halves of the tank together.

Referring now to FIGS. 21, 22, 23, and 24, in those cases where locking dogs 84 and seals 82 or 90 are both deemed to be desirable as back up fail safe devices the locking dogs 84 are positioned so that they are between the upper hull and lower hull seals 82 or 90.

In constructing such as system, the walls have to be built from the rim toward the implosion dome, with the locking dogs and seals built into the system early in construction.

Figure 25:
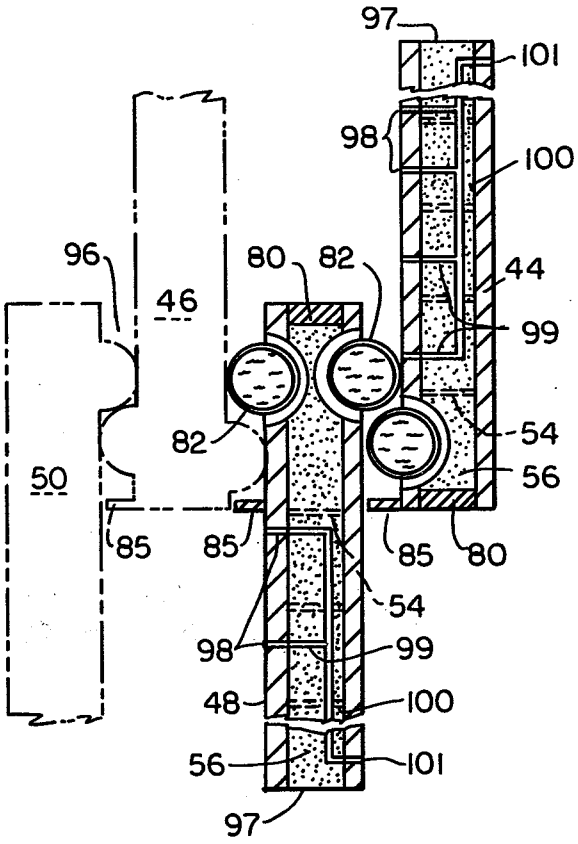
FIG. 25 is a view in side elevation and vertical section of a segment of the outer wall of the double piston tank illustrating a hull venting arrangement in conjunction with a seals and locking dogs.
Figure 9:
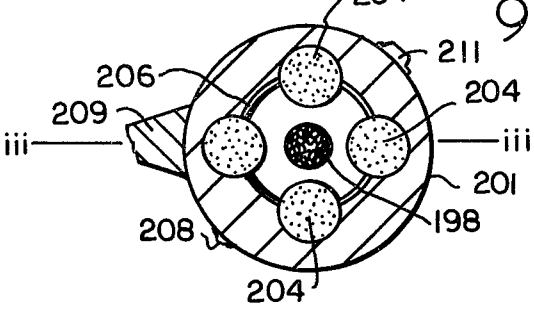
FIG. 9 is a top plan view in section taken along the line 9—9 in FIG. 8.
Figure 7:
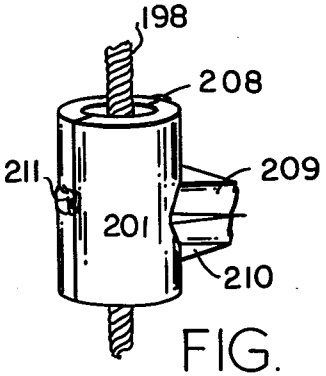
FIG. 7 is an enlarged detailed view in perspective of a stabilizing guide sleeve of a tank which slides up and down on a tensioned cable.
Figure 8:
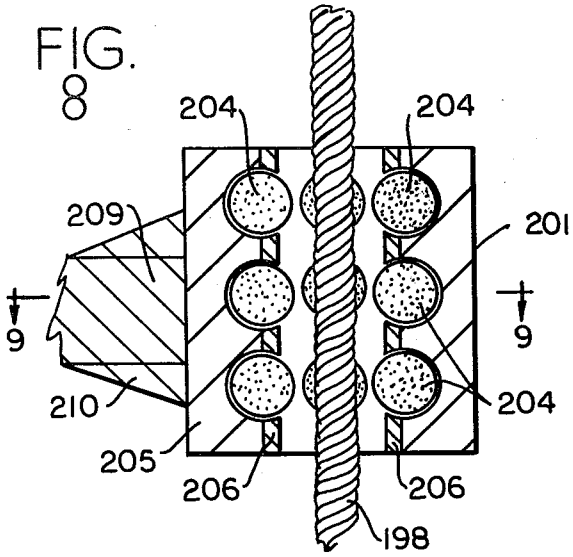
FIG. 8 is an enlarged view in side elevation and vertical section of the guide sleeve shown in FIG. 7.
Figure 26:
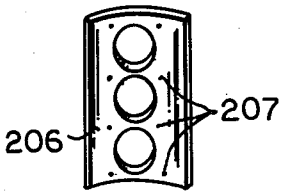
FIG. 26 is a view in perspective of a single bearing retaining plate for the stabilizing guide assembly (looking outward).

Turning finally to FIG. 25, in order to vent safely small amounts of LEG which might for a number of reasons leak into the dead space between the cryogenic walls 46 and 50 and the ambient walls 44 and 48 a system to remove this material collector lines 100 run vertically for nearly the length of each double wall internally, and, they are spaced around the circumference of the hull at distances which would be most advantageous to promote efficient operation and to provide redundancy. Primary vent lines 99 are positioned so that they run horizontally from the inner wall of the ambient hull to the collector line 100 and are spaced vertically along the collector line. Regardless of the position of each hull relative to the other hull, enough primary lines remain open to the dead space to vent gasses efficiently to the environment.

Small amount of LEG which might from time to time successfully negotiate the seal mechanisms 82 or 90 would be expected to regasify in the dead space between the hulls of each tank half. This problem would be slightly more likely to occur in the lower hull then the upper hull because two additional seals act as barriers before the gas reaches the upper hull dead space.

The gas in the dead space would be allowed to build up pressure to a variably controllable point equal to total ambient sea pressure before tripping internal bleeder valves 98 and venting the gas into the primary vent lines 99 and subsequently into the collector lines 100. If the pressure in the line was higher than the ambient water pressure, the gas would vent automatically. If the ambient pressure was greater than the line pressure, then a pump that is an integral part of the internal set of bleeder valves would pump the gas from the dead space in the hulls to lower the pressure in the hull dead space 96 such as in unloading operations and as a fail safe device, increasing the pressure in the lines until the pressure in the venting system was greater than in the ambient environment. Then the external bleeder valves 101 would vent automatically.

Having thus described an embodiment of the invention, it will now be appreciated that the objects of the invention have been fully achieved, and it will be understood by those skilled in the art that many changes in construction and widely differing embodiments and applications of the invention will suggest themselves without departure from the spirit and scope of the invention. The disclosures and the description herein are purely illustrative and are not intended to be in any sense limiting.

I claim:

1. In an offshore submarine storage facility in the ocean and the like for liquified energy gases and similar liquid materials at cryogenic temperatures which includes a vertically compressible insulated submarine storage tank positionable at various selected depths in the water for storing said liquid materials, said tank including ambient water pressure transfer means for transferring external ambient water pressures available at a selected depth to the liquified material stored therein without intermixture of water and liquified material to aid maintaining its liquid state, an improvement comprising:

frame means surrounding said tank and to which said tank is slidably attached, for anchoring said tank in place in the ocean and for enabling said tank to be positioned at said selected depths, said frame means including openable gate means therein, adjacent the surface of the ocean, for enabling said tank to be installed in and removed from said frame means, while said tank is floating at the surface of the ocean.

2. In an offshore submarine storage facility in the ocean and the like for liquified materials at cryogenic temperatures in which the facility includes a vertically compressible insulated submarine storage tank positionable at various selected depths in the water, for storing said liquified material, for transferring external ambient water pressure available at a selected depth to the liquified material to aid in maintaining its liquid state, and without intermixing seawater and liquified material, an improvement comprising:

a base anchored to the floor of the ocean, a platform including ballasted flotation means for floating said platform at the surface of the ocean, a plurality of tensioned cables connecting to and extending between said base and said platform and to which said storage vessel is secured for vertical movement in a range between said base and said platform.

3. The offshore facility as set forth in claim 2 wherein said platform includes openable gate means therein for enabling said tank to be installed in and removed from said facility.

4. The offshore facility as set forth in claim 2 further comprising openable sleeves secured to said tank and slidably mounted over said tensioned cable to guide and retain said tank in place as it moves vertically in its range of movement between said base and said platform.

5. In an offshore submarine storage facility in the ocean and the like for liquified materials at cryogenic temperatures in which the facility includes a plurality of vertically compressible insulated submarine storage tanks positionable at various selected depths in the water, for storing said liquified material, for transferring external ambient water pressure available at a selected depth to the liquified material to aid in maintaining its liquid state, and without intermixing seawater and liquified material, an improvement comprising:

a base anchored to the floor of the ocean, a platform including ballasted flotation means for floating said platform at the surface of the ocean, a plurality of tensioned cables connecting to and extending between said base and said platform and to which said storage vessel is secured for vertical movement in a range between said base and said platform, an opening in said platform sized to receive one of said plurality of tanks, and lifting means attached to said platform for engaging and lifting said tank out of the water, for inspection and maintenance thereof.

6. The offshore facility set forth in claim 5 wherein said opening is centrally located through said platform, and said lifting means comprises a carriage which engages said tank and then moves upwardly with said tank locked therein, so that said tank is lifted out of the water for maintenance, inspection, and the like.

7. In an offshore submarine storage facility in the ocean and the like for liquified materials at cryogenic temperatures in which the facility includes submarine storage tanks positionable at various selected depths in the water, for storing said liquified material, for transferring external ambient water pressure available at a selected depth to the liquified material to aid in maintaining its liquid state, and without intermixing seawater and liquified material, an improvement comprising:

a base anchored to the floor of the ocean and a frame extending therefrom to the surface, said frame enclosing said tanks to which they are movably attached, a platform at the surface of the ocean supported by said frame, an opening in said platform sized to received one of said plurality of tanks, and lifting means attached to said platform for engaging and lifting said tank out of the water, for inspection and maintenance thereof.

8. The offshore facility set forth in claim 7 wherein said opening is centrally located through said platform, and said lifting means comprises a carriage which engages said tank and then moves upwardly with said tank locked therein, so that said tank is lifted out of the water and is supported securely while out of the water for maintenance, inspection and the like.

9. In an offshore submarine storage facility in the ocean and the like for liquified energy gases and similar liquid materials at cryogenic temperatures which includes a vertically compressible insulated submarine storage tank positionable at various selected depths in the water for storing said liquid materials, said tank including ambient water pressure transfer means for transferring external ambient water pressures available at a selected depth to the liquified material stored therein without intermixture of water and liquified material to aid maintaining its liquid state and a conduit from said tank to the surface, an improvement comprising:

an emergency conduit separator coupling in said conduit including separation inducing means for separating in response to an emergency signal, and emergency cutoff valve means at said tank for cutting off said tank from said conduit, said cutoff valve means being responsive to the same emergency signal, whereby, in the event of an emergency, said conduit may be separated, said valve means closed and said tank then submerged to the greatest available depth.

10. In an offshore submarine storage facility in the ocean and the like for liquified energy gases and similar liquid materials at cryogenic temperatures which includes a two-part vertically telescoping insulated submarine storage tank positionable at various selected depths in the water for storing said liquid materials, said tank including ambient water pressure transfer means for transferring external ambient water pressures available at a selected depth to the liquified material stored therein without intermixture of water and liquified to aid maintaining its liquid state and a hose from the top of said tank to the surface, an improvement comprising:

material collecting and discharging means fixed to the bottom of said tank, for discharging and collecting material to and from said tank, extensible interior conduit means connected from said hose to said material collecting and discharging means.

11. The offshore facility set forth in claim 10 wherein said extensible interior conduit means comprises a seabed telescoping transfer pipe.

12. In an offshore submarine storage facility in the ocean and the like for liquified energy gases and similar liquid materials at cryogenic temperatures which includes a two-part vertically telescoping insulated submarine storage tank positionable at various selected depths in the water for storing said liquid materials, said tank including ambient water pressure transfer means for transferring external ambient water pressures available at a selected depth to the liquified material stored therein without intermixture of water and liquified material to aid maintaining its liquid state, an improved locking mechanism for the two parts of said tank, comprising:

a plurality of outwardly extending flange segments at the outer edge of one said tank part and, a plurality of inwardly extending flange segments at the outer edge of the other said tank part, said outwardly extending segments complementing and vertically aligned with said inwardly extending segments when said parts are together in an operational rotational alignment, and said outwardly extending segments vertically clearing said inwardly extending segments when said parts are in a second, separation rotational alignment.

13. In an offshore submarine storage facility in the ocean and the like for liquified materials at cryogenic temperatures in which the facility includes a two-part vertically telescoping insulated submarine storage tank positionable at various selected depths in the water, for storing said liquified material, for transferring external ambient water pressure available at a selected depth to the liquified material to aid in maintaining its liquid state, and without intermixing seawater and liquified material, each part of said tank including a substantially cylindrical telescoping wall portion in a sealed sliding engagement with a complementary portion of the other such part, an improvement comprising:

an annular interior trough circumferencing one of said wall portions, a seal liner positioned within said trough, a rotatable torus shaped seal slidably seated against said liner and abutting against said other wall portion, said seal adapted to roll about its central annular axis as said tank telescopes, so as to render said telescoping wall portion in said sealed sliding engagement.

14. In an offshore submarine storage facility in the ocean and the like for liquified materials at cryogenic temperatures in which the facility includes a two part vertically telescoping insulated submarine storage tank positionable at various selected depths in the water, for storing said liquified material, for transferring external ambient water pressure available at a selected depth to the liquified material to aid in maintaining its liquid state, and without intermixing seawater and liquified material, each part of said tank including a substantially cylindrical telescoping wall portion in a sealed sliding engagement with a complementary portion of the other such part, an improvement comprising:

a plurality of adjacent cylindrical seals each having one smooth cylindrical seating surface seated against said one portion and another generally scalloped cylindrical surface defining a plurality of annular horizontal semi-tori compressibly abutting against said other wall portion, said seal adapted to slide as said tank telescopes, so as to render said telescoping wall portion in said sealed sliding engagement.

15. In an offshore submarine storage facility in the ocean and the like for liquified energy gases and similar liquid materials at cryogenic temperatures which includes a two-part vertically telescoping insulated submarine storage tank positionable at various selected depths in the water for storing said liquid materials, said tank including ambient water pressure transfer means for transferring external ambient water pressures available at a selected depth to the liquified material stored therein without intermixture of water and liquified material to aid maintaining its liquid state, said tank including a top part having double walls and a bottom part having double walls which interleave with said other double walls in a sealed sliding engagement, an improvement comprising:

a venting means for venting sealed dead spaces between said pairs of complementary double walls to remove fluids otherwise trapped therein.

* * * * *

UNITED STATES PATENT AND TRADEMARK OFFICE

CERTIFICATE OF CORRECTION

PATENT NO. : 4,365,576

DATED : December 28, 1982

INVENTOR(S) : SIDNEY F. COOK

It is certified that error appears in the above-identified patent and that said Letters Patent are hereby corrected as shown below:

Column 1, line 27, "throughtout" should be --throughout--;

Column 1, line 33, "dispite" should be --despite--;

Column 1, line 64, "Comlex" should be --Complex--;

Column 2, line 46, "storae" should be --storage--;

Column 3, line 42, "gaseons" should be --gaseous--;

Column 12, line 42, "then" should be --than--;

Column 14, line 68, claim 10, insert --material-- between "liquified" and "to";

Column 8, line 1, "lowered" should be --powered--.

Signed and Sealed this

*Eighteenth* Day of *October 1983*

[SEAL]

*Attest:*

*Attesting Officer*

GERALD J. MOSSINGHOFF

*Commissioner of Patents and Trademarks*